US007311125B2

(12) United States Patent
Krulitsch

(10) Patent No.: US 7,311,125 B2
(45) Date of Patent: Dec. 25, 2007

(54) BEVERAGE BOTTLE HANDLING AND FILING MACHINE FOR CONTAINERS SUCH AS BOTTLES AND CANS

(75) Inventor: Dieter Rudolf Krulitsch, Bad Kreuznach (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 482 days.

(21) Appl. No.: 10/952,706

(22) Filed: Sep. 29, 2004

(65) Prior Publication Data

US 2005/0092390 A1 May 5, 2005

(30) Foreign Application Priority Data

Oct. 2, 2003 (DE) ..... 103 46 044

(51) Int. Cl.
*B65B 43/42* (2006.01)

(52) U.S. Cl. ..... 141/149; 141/148; 141/165; 141/172; 141/275; 53/250

(58) Field of Classification Search ..... 141/144–150, 141/165, 172, 275; 53/428, 250
See application file for complete search history.

(56) References Cited

U.S. PATENT DOCUMENTS 3,172,436 A * 3/1965 Wilhere et al. ..... 141/146
3,386,480 A * 6/1968 Riesenberg ..... 141/147
4,616,684 A * 10/1986 Tincati ..... 141/114
4,721,138 A * 1/1988 Simonazzi ..... 141/150
5,219,405 A * 6/1993 Weiss ..... 141/149
5,295,517 A * 3/1994 Ahlers ..... 141/1
5,301,725 A * 4/1994 Meinzinger ..... 141/372
5,896,898 A * 4/1999 Crossdale et al. ..... 141/83

FOREIGN PATENT DOCUMENTS

| | | |
|---|---|---|
| DE | 2164070 | 8/1972 |
| EP | 0 616 971 A | 9/1994 |
| EP | 0 989 088 A | 3/2000 |

OTHER PUBLICATIONS

European Patent Office Search Report EP1520833 A1 and English translation thereof.

* cited by examiner

*Primary Examiner*—Timothy L. Maust
(74) *Attorney, Agent, or Firm*—Nils H. Ljungman & Associates

(57) ABSTRACT

Beverage bottle handling and filling machine for containers, such as bottles and cans, with lifting devices to lift the containers by the mouth or neck upward to engage beverage discharge openings to permit filling. The filling machine has a piston/cylinder arrangement that is designed to be pressurized to exert a force on the lifting device in the direction of the initial upward movement to tighten the seal between the bottle mouth and the discharge opening. The cylinder chamber is realized in the form of a duct for permitting flow of pressure media to pressurize the container and the piston/cylinder arrangement.

20 Claims, 7 Drawing Sheets

BEVERAGE BOTTLE HANDLING AND FILING MACHINE FOR CONTAINERS SUCH AS BOTTLES AND CANS

BACKGROUND

1. Technical Field

This application relates to a handling machine for containers such as bottles, cans etc., for example of a bottling machine for bottling liquids in bottles with filler valves located on a rotor and lifting devices associated with the filling valves to lift the bottles toward the discharge openings, whereby the lifting devices are realized in the form of lifting rods that can be moved vertically against a spring force with holding devices located in the lower area in the form of grippers, support and centering surfaces for the container mouth and/or the neck collar of the container.

2. Background Information

In particular during the bottling of beverages such as mineral water, beer or other carbonated beverages, for example, under counterpressure, lifting devices are used, the lifting cylinders of which are realized with bottom or support plates. The bottles standing vertically on these plates, optionally with the use of corresponding centering grooves, are lifted toward the discharge openings of the filler valves, lowered after the filling process has been completed, removed from the filling machine and transported to a capping machine.

Because the beverage is under pressure, to prevent excessive foaming, a corresponding counterpressure must be established in the bottles to be filled. For this purpose, before the actual filling process, and optionally with the inclusion of additional measures such as pre-evacuation, flushing with a sterilization medium, etc., the bottles are pre-pressurized with the pressure prevailing in the bottling machine boiler, using the carbon dioxide in the boiler.

Designs of the prior art have pressing devices which are engaged in an appropriate manner with the container—for example a plate that engages the bottom of the container—to press the container against the filling mechanism as necessary. In the designs of the prior art, the pressure force is applied by compression piston devices which are located underneath the bottle plate, for example, or can be suspended on the filling mechanism. What the constructions of the prior art have in common is the pressurization of the compression piston arrangement with a compressed gas from a separate compressed gas source, which has an adjustable constant pressure during the working stroke. The application force is thus constant during the operation of the filling mechanism. In the designs of the prior art, the compression piston arrangements are pressurized constantly, and therefore operate according to the principle of a pneumatic spring. The application device is lowered and raised against the piston pressure by means of guide cams or similar mechanisms. For safety reasons, the application force is set high enough by a suitable selection of the pressure of the compressed gas that pressurizes the pressure piston arrangements so that there is always sufficient pressure for all the beverages being bottled in the plant, which can have different levels of carbonization pressures, to prevent foaming or the escape of gas or fluid on the edge of the container. This method has the disadvantage, however, that the pressure force is generally too high, i.e. higher than necessary. However, the level of the pressure force affects the wear of parts at various points on the filling device, such as, for example, the gaskets or the components of the bottle pressing device. Therefore a sealing force that is too high is a disadvantage. It is also obvious that a significant pressure is also exerted on the bottles themselves when they are pressed against the filler valves. Such a pressure seldom or only rarely has any corresponding disadvantages when it is exerted on glass bottles, but that is not the case with plastic bottles, which are being used to an increasing extent, and on which the clamping pressure between the filling valves and the bottom support plates causes an unacceptable and undesirable deformation of the cylindrical portion of the bottle. To prevent this problem, lifting devices are used that have grippers located on support rods or support surfaces that come into contact with the neck collars located in the mouth area of plastic bottles or other commonly used containers. A filling machine of this type is known from publications in the prior art. The support rods are thereby located with the corresponding support surface as an independent component with a cam roller underneath the outlet of the filler valves.

OBJECT OR OBJECTS

Beginning with such a support rod lifting device of the prior art, the object of the invention is a simplified construction that is practically a part of the handling heads of such a container handling machine and can be integrated into the handling process with regard to the delivery of the media and the pressurization.

SUMMARY

One embodiment teaches that on a container handling machine of the type described above, above the dispenser openings in and/or on the filler valve, there is a movable piston/cylinder arrangement that can move the lifting device in the direction in which the bottle is to be pressed against the filler mechanism, whereby the cylinder chamber of the piston/cylinder arrangement is realized in the form of a flow-through or inlet channel for the pressure media to the delivered to the container to be filled and/or to be removed from the container, such as flushing gas, pressure and counterpressure gas, inert gas or sterilization media.

Such a configuration results in an extremely simple, compact lifting device, the function of which is integrated with the function of the filling valve. At least all the pressurized process steps can thereby be exploited or utilized for the direct actuation of the lifting device.

Additional configurations of possible embodiments are described herein below.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiment illustrated in the accompanying drawings, in which.

DESCRIPTION OF EMBODIMENT OR EMBODIMENTS

This invention is described on the basis of a filling machine that fills bottles on the basis of filling by volume. However, it can also be used on any other filling machine or bottle handling machine.

Figure 1:
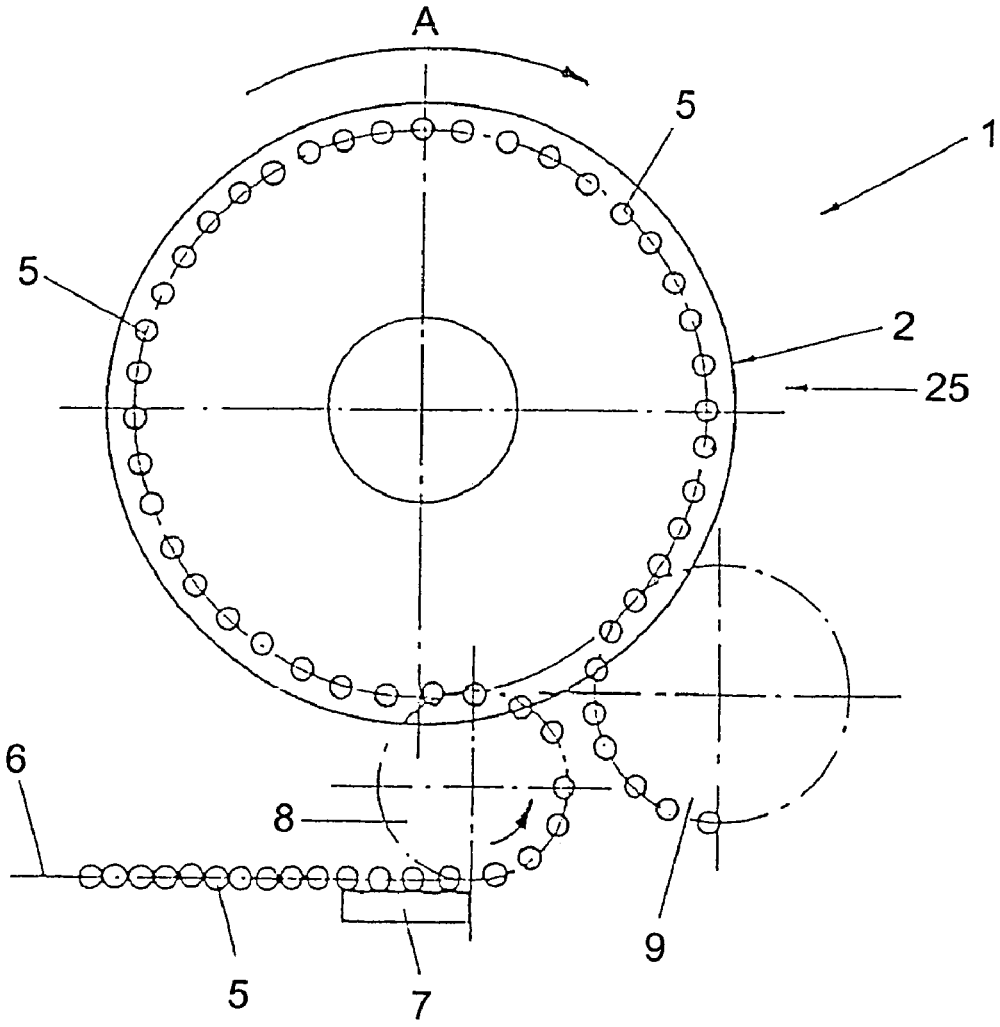
FIG. 1 is a schematic plan view of a filling machine with a rotating construction for filling a liquid substance into bottles.
Figure 2:
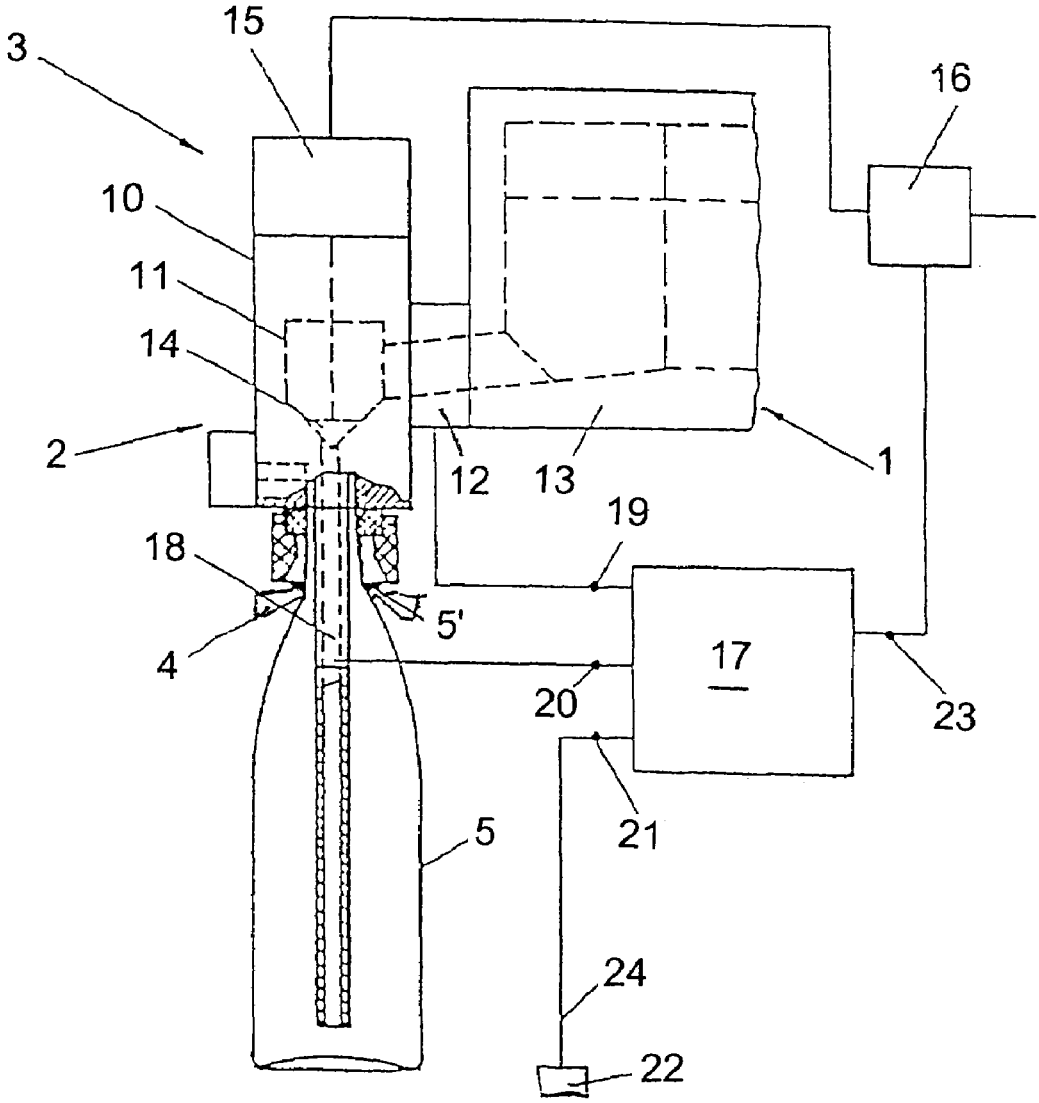
FIG. 2 is a simplified view with a block diagram and flow diagram of one of the filling elements of the filling machine illustrated in FIG. 1, together with a corresponding control system.

The filling machine illustrated in FIG. 1 is a bottling machine for counterpressure filling, for example for the bottling of soft drinks, beer, mineral water etc., and consists essentially of a rotor 1 that rotates around a vertical machine axis in the direction of the arrow A, and on the periphery of the rotor 1 a number of filling positions 2 are formed which in the exemplary embodiment illustrated in FIG. 2 each consist of a filling element and a bottle carrier 4 that can be moved up and down by a lifting device. FIG. 1 shows all the filling positions between a bottle inlet and a bottle outlet of the filling machine, each of which is occupied by a plastic bottle (PET bottle).

The bottles 5 to be filled are fed to the filling machine via a conveyor 6, by means of a spacing screw 7 or are otherwise placed at the required spacing and transferred by means of an inlet star wheel 8 each to a filling position of the rotor 1. The filled bottles 5 are removed from the filling positions on an outlet star wheel 9 and transported to a capper, for example, which is not shown in the drawing.

Each filling element has, in the conventional manner, among other things, in a housing 10 of this filling element, a liquid duct 11, which is in communication with its one end via a volume flow meter 12 or otherwise with a ring bowl 13 for the liquid being bottled that forms a portion of the rotor 1.

With its other end, the liquid duct 11 forms a discharge opening provided on the underside of the housing 10, via which the liquid being bottled then flows to the respective bottle 5 when the liquid valve 14 which is also provided in the liquid channel 11 is opened.

Each filling element 3 also has an actuator device 15 to control the liquid valve 14 or to control a valve body of this liquid valve. The actuator element 15 is preferably a pneumatic actuator element which is actuated by a control device 17 by means of an electromagnetic control valve 16. Each filling element 3 also has, for example, a probe 18 that determines the fill level, which is realized for example in the form of a conductance probe, whereby the probe 18 is immersed in the liquid being bottled and supplies a probe signal when, during the filling of a bottle 5, the level of the liquid being bottled reaches a specified level in the bottle 5 that is provided at the filling element 3 or pressed against it. In the illustrated exemplary embodiment, the electronic control device 17, which is preferably a microprocessor-assisted device, has a total of three inputs 19, 20 and 21, of which the input 19 is connected to the signal output of the flow meter 12, the input 20 is connected to the probe 18 and the input 21 is connected to a common higher-level electronic control system (higher-level processor) for all the filling positions of the filling machine, as are the control devices 17 of the other filling positions 2 or filling elements 3. The control device 17 of each filling element 3 also has an output 23, by means of which the individual control valve 16 associated with each filling element 3 is actuated.

The operation of the filling machine and of each filling position 2 can be described as follows: After the respective bottle 5 has been transferred from the inlet star 8 to a filling position 2, in a specified angular range of the rotational movement of the rotor 1, after a pre-pressurization of the bottle 5 with its mouth 5' tight against the respective filling element 3, in the filling phase under counterpressure, first there is a volume filling of the bottle 5 with the liquid being bottled, i.e. the liquid valve 4 is opened to begin this filling phase. The volume filling is then ended by closing the liquid valve 14 when a specified volume of the liquid being bottled has been dispensed into the bottle provided at the respective filling position 2.

The volume filling is controlled on the basis of the quantity signal supplied by the flow meter 12. This signal consists, for example, of a pulse sequence, in which the number of pulses per unit of time is a yardstick for the flow or volume of the liquid being bottled that has flowed through the flow meter 12 in the unit of time in question. When the desired filling volume is reached, the control device 17 actuates the control valve 16 so that the liquid valve 14 is closed by means of the actuator element 15.

By means of the central control unit 22, the setpoint value for all the filling positions 2 and their control devices 17 can be input all at the sale time, namely by means of the signal line 24.

After the filling has been completed, and still under counterpressure with its mouth 5' still pressed tight against the filling element 3, the bottle 5 can be filled to the exact level desired by means of the probe, which ensures that the level of the liquid being bottled in the bottles 5 is uniform. Otherwise the next phase is the conventional depressurization of the respective bottle 5.

The container handling machine described above in the form of a filling machine can be realized and operated in a variety of different realizations, and its construction can be modified in any solutions that can be derived from the prior art.

Figure 3:
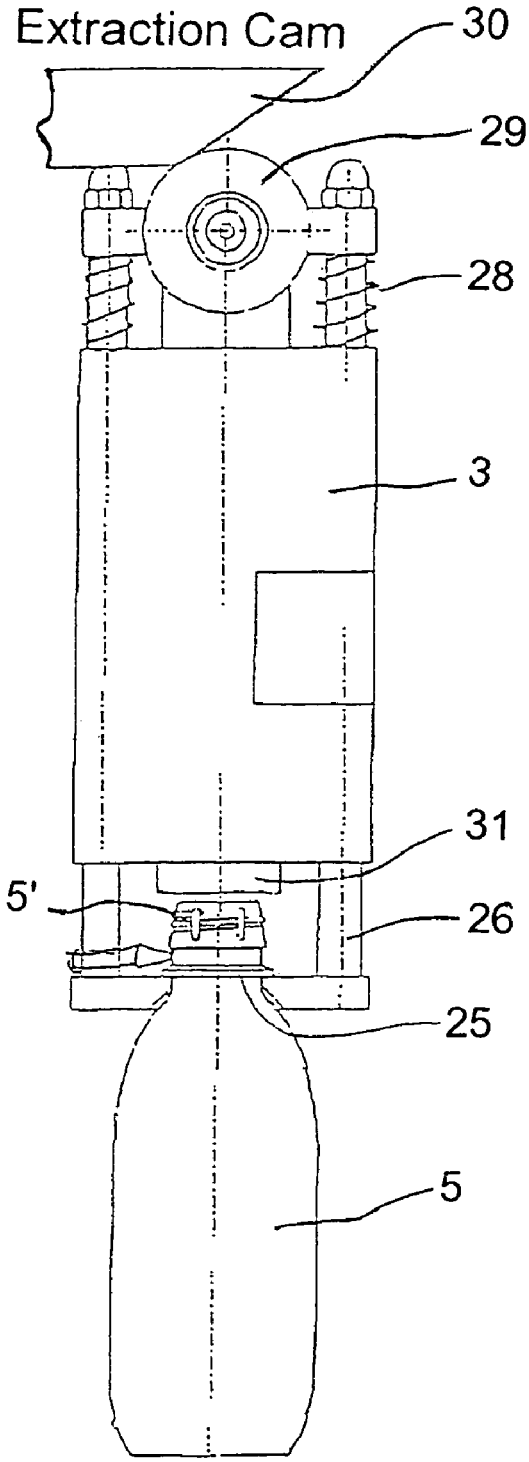
FIG. 3 shows the lifting device claimed by the invention on a handling head in the form of a filler element with a raised bottle.
Figure 4:
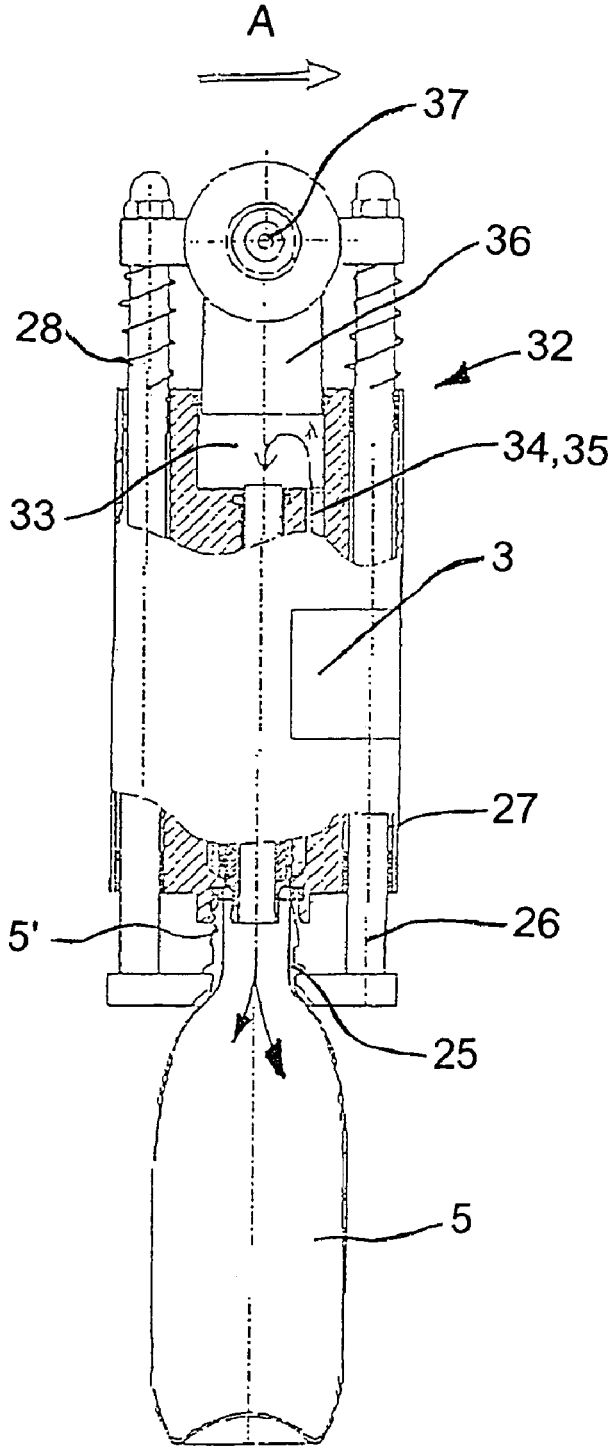
FIGS. 4 and 5 show the lifting device on a filling valve as illustrated in FIG. 3 in the counterpressure and filling phase.
Figure 5:
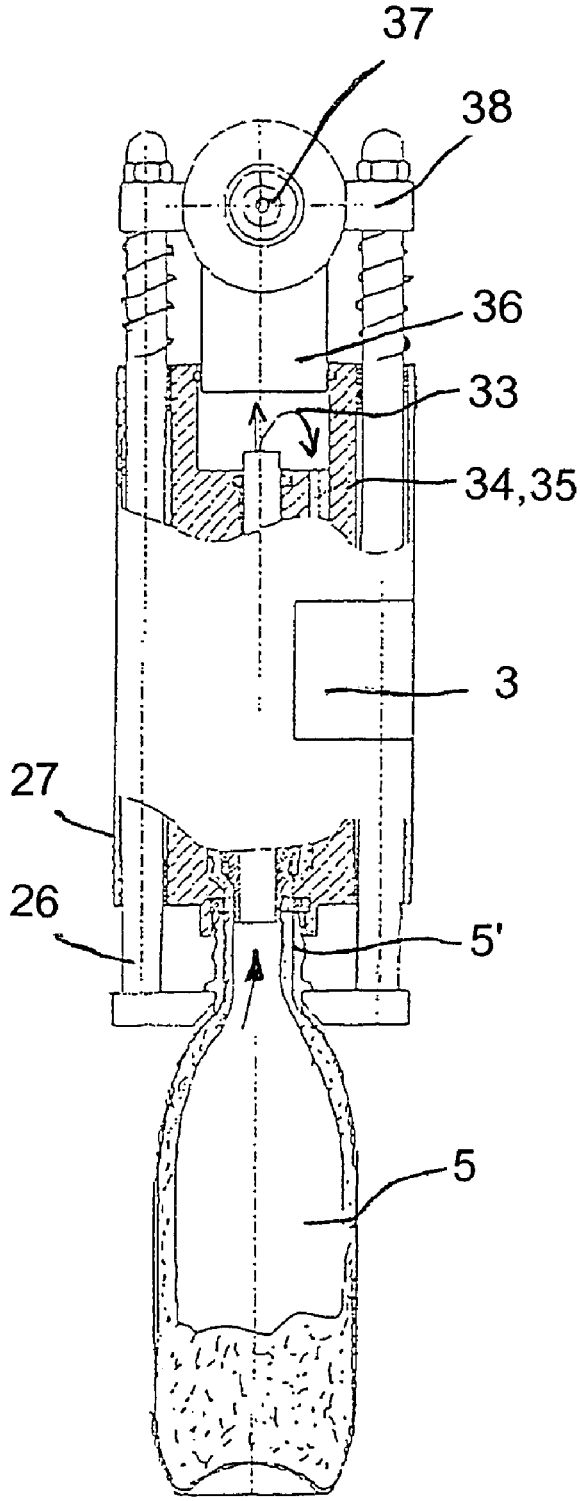

In the exemplary embodiment illustrated in FIGS. 3, 4 and 5, the holding devices are realized in the form of centering surfaces that support the neck collar 25 of a bottle 5 and are fastened to vertically movable lifting rods 26. The lifting rods 26 are held in guides 27 of the filling element 3 and are pressed by means of compression springs 28 with a guide roller 29 against a control cam 30, which causes a downward movement of the lifting elements by means of the guide roller 29 with which it is in contact. In this lower position, as shown in FIG. 3, for example, the bottles 5 are transferred to the centering surfaces. After taking over a supported bottle 5 and leaving the vicinity of the control cam, the bottles travel toward the discharge opening 31 of the filling element 3 and are pressed against the filling element only by the application force of the springs 28. The actual main pressing then begins when the filling process begins. For this purpose, as in the exemplary embodiment illustrated in FIGS. 3, 4 and 5, there is a piston/cylinder arrangement 32 above the discharge opening 31 on the filling valve body. As illustrated, the cylinder chamber 33 is appropriately realized in the form of the filling valve 3 and in the form of a pressure or entrance duct 34, 35 so that the fed bottles 5 can be filled and/or the pressure media in them can be discharged, e.g. flushing gas, counterpressure gas and pressurization gas, inert gas, sterilization media etc. The piston 36 is connected with the lifting roller bearing system 37 or its support 38 and is movable relative to the filling elements 3 fastened to the rotor 1. The optimum pressure of the bottle mouth 5' against the discharge channel or the dispensing openings is always ensured by the automatic pressurization of the cylinder chamber 33 with the compressed gas or similar gas used in the respective process. For the conventional CIP cleaning of such bottling machines, corresponding deflector or rinse heads can be mounted on the holding devices, in which case the rinsing or flushing medium or the rinsing or flushing pressure is used to press the rinse heads against the other parts of the machine. The piston 36 can also be realized in the form of an appropriately constructed membrane.

Figure 4A:
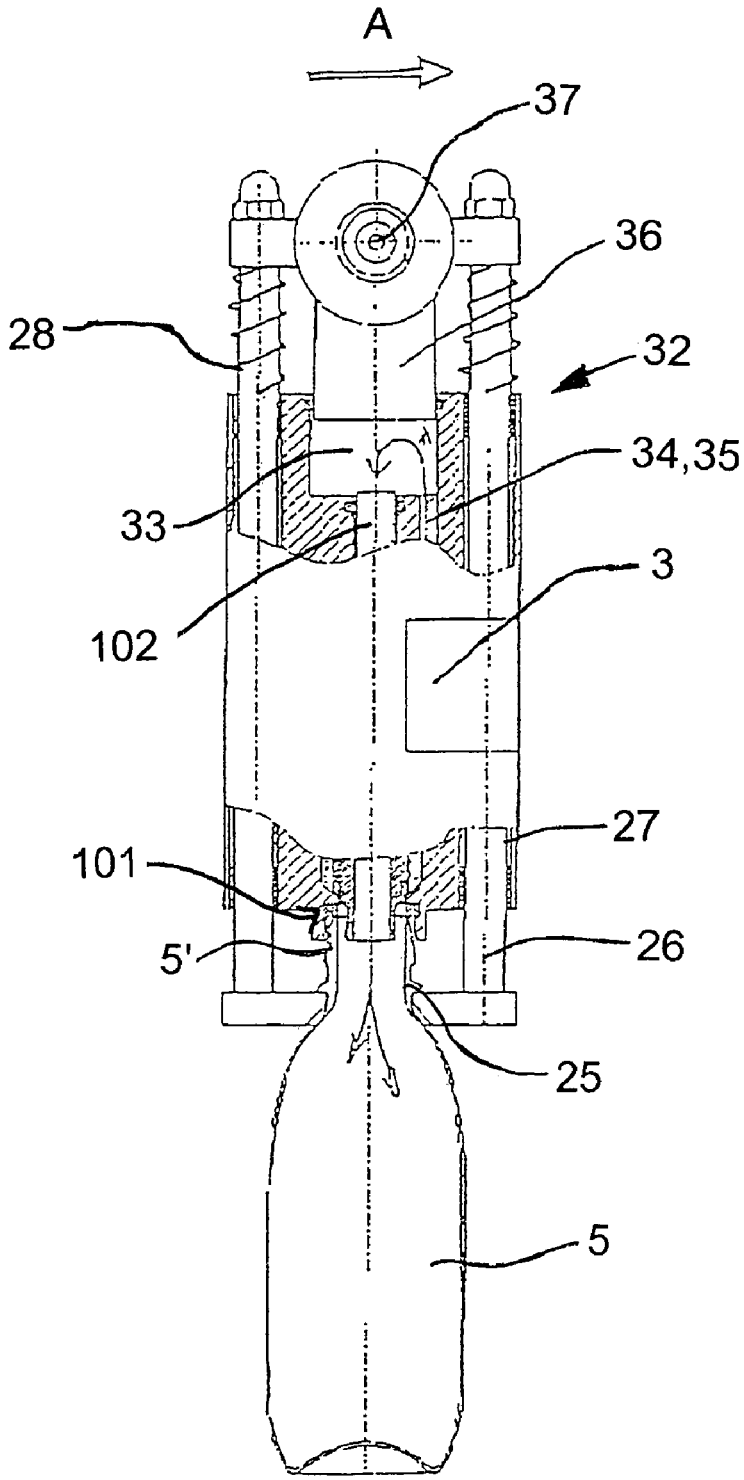
FIGS. 4A and 5A show the views shown in FIGS. 4 and 5 with additional numbering.
Figure 5A:
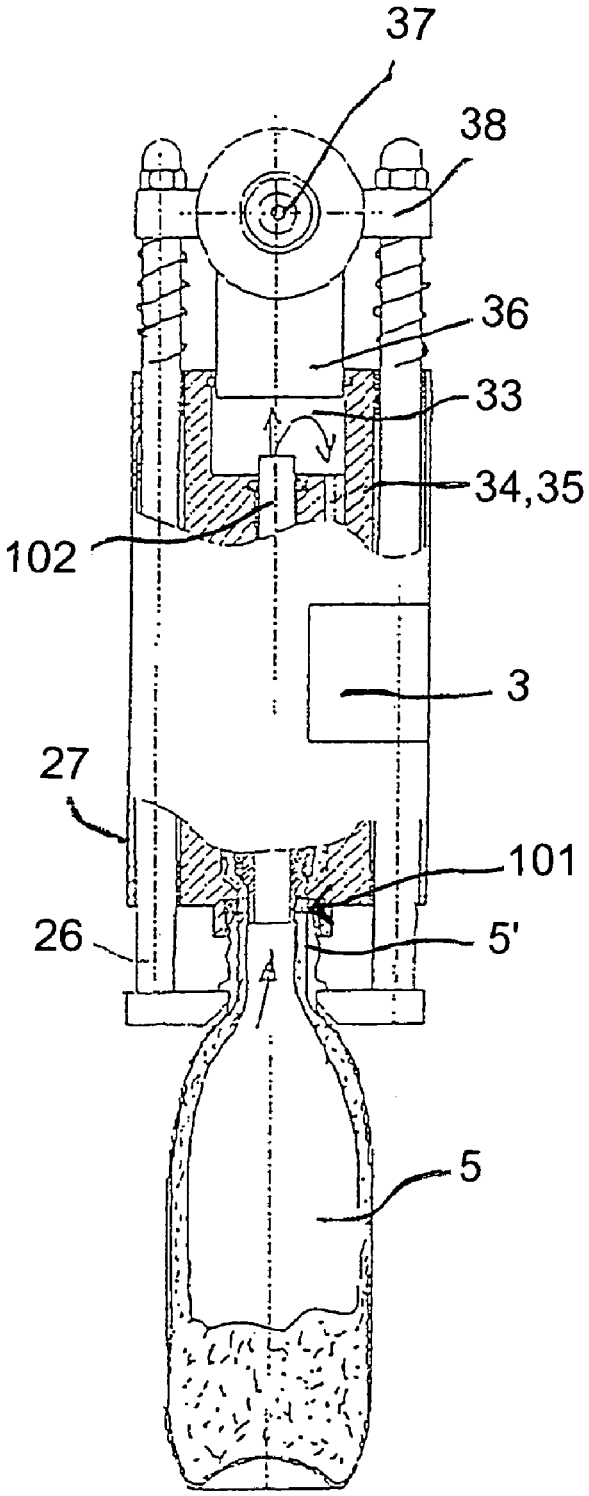

FIGS. 4A and 5A show the views shown in FIGS. 4 and 5 with additional numbering.

To further explain, in a filling process according to one possible embodiment, the bottle holding and filling device, such as shown in FIGS. 3, 4, and 5, has the guide roller 29 that is positioned and designed to come in contact with the cam structure 30. When the guide roller 29 comes in contact with the cam structure 30, the guide roller 29 and the lifting roller bearing system 37 are displaced downward in a vertical movement. Substantially simultaneously, the lifting rods 26, which are connected to the lifting roller bearing system 37 by the support arms 38, also are moved or displaced in a downward vertical movement within their corresponding guides 27, which are located in the filling element structure 3. The filling element structure 3 is mounted on a rotary filling machine carousel (see FIGS. 1 and 2) and does not move vertically. Consequently, the lifting rods 26 are moved vertically downward with respect to the filling element structure 3.

By moving the lifting rods 26 downward, the bottle carrier or holding structure 4 (see FIG. 2), which is connected to the lifting rods 26, is also substantially simultaneously moved downward with respect to the filling element structure 3. In this manner, the space between the bottle carrier 4 and the filling element structure 3 is increased such that the mouth 5' of the bottle 5 can be inserted into the space. The bottle 5 is held by its bottle neck by the bottle carrier 4 and is now ready to be filled with a beverage.

In the next step, the filling machine carousel rotates and the guide roller 29 is taken out of engagement with the cam structure 30. At this point the spring elements 28 are released from the pressure exerted on them by the downward movement of the guide roller structure 29 and lifting rods 26. The spring elements 28 cause the lifting rods 26 to move upward by exerting force against the top of the vertically stationary filling element structure 3 and the support arms 38. In this manner, the lifting rods 26, and substantially simultaneously the bottle carrier 4, are moved or displaced vertically upward with respect to the filling element structure 3. As a result, the mouth 5' of the bottle 5 is brought into a sealing engagement with the discharge opening 31.

The mouth 5' is now engaged with the discharge opening 31 and held in place there by the force of the springs 28. This is advantageous because a seal is established between the mouth 5' and a gasket structure 101 (see FIGS. 4A and 5A) of the discharge opening 31 without using excessive pressure as discussed above with respect to the prior art. Since the force of the springs 28 is not excessive in comparison to the force exerted by other known pressing devices, such as separate compression piston devices, the life of the gasket structure 102 will be extended since wear and tear produced by excessive pressure may be substantially reduced or essentially eliminated.

After this initial seal is established between the bottle mouth 5' and the gasket structure 101 of the discharge opening 31, pressure media, such as flushing gas, counterpressure gas and pressurization gas, inert gas, sterilization media, etc., can be introduced into the interior of the bottle 5. The pressure media can be transported into the bottle 5 through a cylinder structure 33. The cylinder structure 33 can have a pressure or entrance duct 34, 35 that permits flow of pressure media into and out of the bottle and cylinder structure 33.

In the embodiment shown in FIGS. 3, 4, and 5, the pressure media flows out of the entrance duct 34, 35 and enters the interior space of the cylinder structure 33 and contacts the piston 36. When the pressure media enters the cylinder structure 33 and contacts the piston 36, a force is exerted on the piston 36 by the initial pressure wave caused by the entrance of the pressure media. The force on the piston 36 is transferred to the lifting roller bearing system 37, which is connected to the piston 36. As a result, an upward-lifting force is exerted on the bottled carrier 4 connected to the roller bearing system 37 by the guide rods 26. This upward-lifting force causes the seal between the gasket structure 101 and the bottle mouth 5' to be tightened to promote an optimum seal. The tightened seal minimizes leakage of pressure media or beverage material during the filling process.

The pressure media substantially simultaneously then travels through a central passage or opening 102 (see FIGS. 4A and 5A) in the cylinder 33 into the bottle 5 to pressurize the interior of the bottle 5 in addition to promoting an optimal seal at the bottle mouth 5'. By maintaining pressure in this manner, foaming of the beverage material during filling can be substantially reduced, which thereby results in increased accuracy in the filling process with respect to the amount of beverage material to be filled into the bottle.

As shown in FIG. 5, the pressure media can then be discharged from the cylinder 33 via the entrance duct 34, 35, such as during filling of the bottle with beverage material. This is advantageous because the pressure media will first exit the bottle 5 as it is pushed out by the inflow of beverage material, thereby maintaining both a substantially constant force on the piston 36 and the tightened seal between the gasket structure 101 and the bottle mouth 5'. In this manner, pressure is maintained in the bottle 5 to prevent foaming, the tightened seal is maintained at the bottle mouth 5' to prevent leakage, and the overpressure or excessive pressure that can shorten the life span of the gasket structure 101 and other similar structures is minimized or essentially eliminated.

In at least one other possible embodiment, the cylinder structure 33 could be designed such that the pressure media travels from the entrance duct 34, 35 directly into the central passage 102 via a connecting passage located in the cylinder structure 33 other than the cylinder chamber below the piston 36. Such a connecting passage would permit the pressure media to flow into the central passage 102, and then substantially simultaneously to both the cylinder chamber and the bottle 5, as well as back out again through the connecting passage as necessary.

The above-described structures can be modified to be used in similar container-handling applications for containers, such as bottles and cans, of various shapes and sizes, and for various types of beverages. The cylinder can be configured to handle different pressure levels as necessary for different types of bottles and beverages. For example, the size and position of the passages, ducts, and channels in the cylinder can be modified to control factors related to the filling process, such as the pressure level, flow rate, and direction of travel of the pressure media. These modifications could be tested by experimentation to achieve a desired pressure for a particular filling process.

One feature or aspect of an embodiment is believed at the time of the filing of this patent application to possibly reside broadly in a handling machine for containers such as bottles, cans, cardboard containers etc., for example a filling machine for the bottling of liquids in bottles with lifting devices located on a rotor/carousel to lift the containers toward the dispenser openings, whereby the lifting devices are realized in the form of lifting rods that can be moved vertically against a spring force with holding devices located in the lower area in the form of grippers, support and centering surfaces for the container mouth and/or the neck collar of the container, characterized by the fact that above the discharge openings in and/or on the filling valve 3 there is a piston/cylinder arrangement 32 that can move the lifting device in the direction of the pressing, the cylinder chamber 33 of which is realized in the form of a flow-through or inlet duct 34, 35 for the pressure media such as flushing gas, pressurization and counterpressure gas, inert gas, sterilization media etc. which are to be fed into the container 5 to be filled and/or extracted from it.

Another feature or aspect of an embodiment is believed at the time of the filing of this patent application to possibly reside broadly in the handling machine, characterized by the fact that the cylinder chamber 33 is located in and/or on the filling valve/filling valve body 3 and the piston 36 is connected with the lifting roller bearing system 37 and/or its support 38.

Yet another feature or aspect of an embodiment is believed at the time of the filing of this patent application to possibly reside broadly in the handling machine, characterized by the fact that the piston 36 is located in and/or on the filling valve body 3 and the cylinder housing 33 is connected with the lifting roller bearing 37 and/or its support 38.

Still another feature or aspect of an embodiment is believed at the time of the filing of this patent application to possibly reside broadly in the handling machine, characterized by the fact that the piston/cylinder arrangement 32 is connected directly with the vertically movable lifting rods 26.

A further feature or aspect of an embodiment is believed at the time of the filing of this patent application to possibly reside broadly in the handling machine, characterized by the fact that a rinsing container can be pressed against the lower filler valve area with grippers, support and centering or application surfaces for the container neck 5'.

Another feature or aspect of an embodiment is believed at the time of the filing of this patent application to possibly reside broadly in the handling machine, characterized by the fact that the feed line for a rinsing and/or sterilization medium is connected or can be connected with the cylinder chamber.

Yet another feature or aspect of an embodiment is believed at the time of the filing of this patent application to possibly reside broadly in the handling machine, characterized by the fact that the piston 36 is realized in the form of a membrane that corresponds to the cylinder chamber 33.

Another feature or aspect of an embodiment is believed at the time of the filing of this patent application to possibly reside broadly in a beverage bottle handling and filling machine for filling beverage bottles with liquid beverage material, said beverage bottle handling and filling machine comprising: a rotary carousel; holding and filling arrangements disposed on the perimeter of said rotary carousel being configured to hold and fill beverage bottles with liquid beverage material; and each of said holding and filling arrangements comprising: a discharge opening to permit the flow of liquid beverage into a beverage bottle; a lifting device to lift a mouth of a beverage bottle into sealing engagement with said discharge opening; said lifting device comprising: a support and centering structure to hold a neck of a beverage bottle; and lifting rods being connected to said support and centering structure and being configured to be moved vertically to permit vertical movement of said support and centering structure; a piston/cylinder arrangement comprising a piston structure connected to said lifting device and a cylinder structure mounted in a stationary manner on said rotary carousel; said piston structure and said lifting device being vertically movable with respect to said cylinder structure; and said cylinder structure comprising: an flow duct to permit flow of pressure media into and out of said cylinder structure; a central passage being operatively connected to said flow duct to permit flow of pressure media into and out of a beverage bottle; a cylinder chamber being operatively connected to said flow duct and disposed adjacent said piston structure; and said cylinder chamber being configured to be filled with pressure media to exert a force on said piston structure to exert a lifting force on said lifting device to tighten the sealing engagement between said discharge opening and a mouth of a bottle.

Still another feature or aspect of an embodiment is believed at the time of the filing of this patent application to possibly reside broadly in a beverage bottle handling and filling arrangement, said beverage bottle handling and filling arrangement comprising: a discharge opening to permit the flow of liquid beverage into a beverage bottle; a lifting device to lift a mouth of a beverage bottle into sealing engagement with said discharge opening; said lifting device comprising: a support and centering structure to hold a neck of a beverage bottle; and lifting rods being connected to said support and centering structure and being configured to be moved vertically to permit vertical movement of said support and centering structure; a piston/cylinder arrangement comprising a piston structure connected to said lifting device and a cylinder structure mounted in a stationary manner on said rotary carousel; said piston structure and said lifting device being vertically movable with respect to said cylinder structure; and said cylinder structure comprising: an flow duct to permit flow of pressure media into and out of said cylinder structure; a central passage being operatively connected to said flow duct to permit flow of pressure media into and out of a beverage bottle; a cylinder chamber being operatively connected to said flow duct and disposed adjacent said piston structure; and said cylinder chamber being configured to be filled with pressure media to exert a force on said piston structure to exert a lifting force on said lifting device to tighten the sealing engagement between said discharge opening and a mouth of a bottle.

A further feature or aspect of an embodiment is believed at the time of the filing of this patent application to possibly reside broadly in a handling machine for containers such as bottles, cans, cardboard containers etc., for example a filling machine for the bottling of liquids in bottles with lifting devices located on a rotor/carousel to lift the containers toward the dispenser openings, whereby the lifting devices are realized in the form of lifting rods that can be moved vertically against a spring force with holding devices located in the lower area in the form of grippers, support and centering surfaces for the container mouth and/or the neck collar of the container, and is characterized by the fact that above the discharge openings in and/or on the filling valve there is a piston/cylinder arrangement that can move the lifting device in the direction of the pressing, the cylinder chamber of which is realized in the form of a flow-through or inlet duct for the pressure media such as flushing gas, pressurization and counterpressure gas, inert gas, sterilization media etc. which are to be fed into the container 5 to be filled and/or extracted from it.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign patent publication applications, namely, Federal Republic of Germany Patent Application No. 103 46 044.6, filed on Sep. 30, 2003, having inventor Dieter Rudolf KRULITSCH, and DE-OS 103 46 044.6 and DE-PS 103 46 044.6, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of container filling machines which may possibly be utilized or adapted for use in at least one possible embodiment may possibly be found in the following U.S. Pat. No. 6,189,293, entitled "Container filling machine;" U.S. Pat. No. 5,950,691, entitled "High-speed liquid filling machine;" U.S. Pat. No. 5,924,462, entitled "Beverage filling machine;" U.S. Pat. No. 5,884,677, entitled "Beverage filling machine;" U.S. Pat. No. 5,533,552, entitled "Bottle filling machine and a cleansing system accessory including an operator therefor;" U.S. Pat. No. 5,494,086, entitled "Bottle filling machine;" U.S. Pat. No. 5,413,153, entitled "Container filling machine for filling open-top containers, and a filler valve therefor;" and U.S. Pat. No. 4,282,698, entitled "Liquid filling machine."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of lifting devices for bottle handling devices which may possibly be utilized or adapted for use in at least one possible embodiment may possibly be found in Federal Republic of Germany Application No. DE P 103 14 634, having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 and having Attorney Reference No. NHL-HOL-72. The above applications are hereby incorporated by reference as if set forth in their entirety herein.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottle handling and filling machine for filling beverage bottles with liquid beverage material, said beverage bottle handling and filling machine comprising:

a rotary carousel;

holding and filling arrangements disposed on the perimeter of said rotary carousel being configured to hold and fill beverage bottles with liquid beverage material; and each of said holding and filling arrangements comprising:

a discharge opening to permit the flow of liquid beverage into a beverage bottle;

a lifting device to lift a mouth of a beverage bottle into sealing engagement with said discharge opening;

said lifting device comprising:

a support and centering structure to hold a neck of a beverage bottle; and lifting rods being connected to said support and centering structure and being configured to be moved vertically to permit vertical movement of said support and centering structure;

a piston/cylinder arrangement comprising a piston structure connected to said lifting device and a cylinder structure mounted in a stationary manner on said rotary carousel;

said piston structure and said lifting device being vertically movable with respect to said cylinder structure; and said cylinder structure comprising:

a flow duct to permit flow of pressure media into and out of said cylinder structure;

a central passage being operatively connected to said flow duct to permit flow of pressure media into and out of a beverage bottle;

a cylinder chamber being operatively connected to said flow duct and disposed adjacent said piston structure; and said cylinder chamber being configured to be filled with pressure media to exert a force on said piston structure to exert a lifting force on said lifting device to tighten the sealing engagement between said discharge opening and a mouth of a bottle.

2. The beverage bottle handling and filling machine as claimed in claim 1, characterized by the fact that the cylinder chamber (33) is located in and/or on the filling valve/filling valve body (3) and the piston (36) is connected with the lifting roller bearing system (37) and/or its support (38).

3. The beverage bottle handling and filling machine as claimed in claim 2, characterized by the fact that the piston (36) is located in and/or on the filling valve body (3) and the cylinder housing (33) is connected with the lifting roller bearing (37) and/or its support (38).

4. The beverage bottle handling and filling machine as claimed in claim 3, characterized by the fact that the piston/cylinder arrangement (32) is connected directly with the vertically movable lifting rods (26).

5. The beverage bottle handling and filling machine as claimed in claim 4, characterized by the fact that a rinsing container can be pressed against the lower filler valve area with grippers, support and centering or application surfaces for the container neck (5').

6. The beverage bottle handling and filling machine as claimed in claim 5, characterized by the fact that the feed line for a rinsing and/or sterilization medium is connected or can be connected with the cylinder chamber.

7. The beverage bottle handling and filling machine as claimed in claim 6, characterized by the fact that the piston (36) is realized in the form of a membrane that corresponds to the cylinder chamber (33).

8. A beverage bottle handling and filling arrangement, said beverage bottle handling and filling arrangement comprising:

a discharge opening to permit the flow of liquid beverage into a beverage bottle;

a lifting device to lift a mouth of a beverage bottle into sealing engagement with said discharge opening;

said lifting device comprising:

a support and centering structure to hold a neck of a beverage bottle; and lifting rods being connected to said support and centering structure and being configured to be moved vertically to permit vertical movement of said support and centering structure;

a piston/cylinder arrangement comprising a piston structure connected to said lifting device and a cylinder structure mounted in a stationary manner on said rotary carousel;

said piston structure and said lifting device being vertically movable with respect to said cylinder structure; and said cylinder structure comprising:

a flow duct to permit flow of pressure media into and out of said cylinder structure;

a central passage being operatively connected to said flow duct to permit flow of pressure media into and out of a beverage bottle;

a cylinder chamber being operatively connected to said flow duct and disposed adjacent said piston structure; and said cylinder chamber being configured to be filled with pressure media to exert a force on said piston structure to exert a lifting force on said lifting device to tighten the sealing engagement between said discharge opening and a mouth of a bottle.

9. The beverage bottle handling and filling arrangement as claimed in claim 8, characterized by the fact that the piston (36) is located in and/or on the filling valve body (3) and the cylinder housing (33) is connected with the lifting roller bearing (37) and/or its support (38).

10. The beverage bottle handling and filling arrangement as claimed in claim 9, characterized by the fact that the piston/cylinder arrangement (32) is connected directly with the vertically movable lifting rods (26).

11. The beverage bottle handling and filling arrangement as claimed in claim 10, characterized by the fact that a rinsing container can be pressed against the lower filler valve area with grippers, support and centering or application surfaces for the container neck (5').

12. The beverage bottle handling and filling arrangement as claimed in claim 11, characterized by the fact that the feed line for a rinsing and/or sterilization medium is connected or can be connected with the cylinder chamber.

13. The beverage bottle handling and filling arrangement as claimed in claim 12, characterized by the fact that the piston (36) is realized in the form of a membrane that corresponds to the cylinder chamber (33).

14. A container handling and filling arrangement, said container handling and filling arrangement comprising:

a discharge opening to permit the flow of liquid into a container;

a lifting device to lift a mouth opening of a container into sealing engagement with said discharge opening to permit liquids to enter a container and gases to enter and exit a container;

said lifting device comprising:

a support structure being configured and disposed to hold a portion of a container; and a lifting arrangement being connected to said support structure and being configured to vertically move said support structure;

a piston and cylinder arrangement comprising a piston structure and a cylinder structure;

said piston and cylinder arrangement being connected to said lifting device and being configured to vertically move said lifting device;

said cylinder structure comprising:

a flow duct to permit flow of a pressure medium into and out of said cylinder structure;

a passage being operatively connected to said flow duct to permit flow of a pressure medium into a container and out of a container during a filling cycle; and at least a portion of said piston structure being disposed in said cylinder structure;

said at least a portion of said piston structure and said cylinder structure being configured to together define a chamber in said cylinder structure;

said chamber being configured and disposed to connect said flow duct and said passage in said cylinder structure to permit the flow of a pressure medium between said flow duct and said passage; and said chamber being configured to receive a pressure medium to exert a lifting force on said lifting device to tighten the sealing engagement between said discharge opening and a mouth opening of a container.

15. The container handling and filling arrangement according to claim 14, wherein said piston structure is operatively connected with a lifting roller bearing system and/or its support.

16. The container handling and filling arrangement according to claim 15, wherein said cylinder structure is operatively connected with said lifting roller bearing system and/or its support.

17. The container handling and filling arrangement according to claim 16, wherein said lifting arrangement comprises vertically movable lifting rods.

18. The container handling and filling arrangement according to claim 17, wherein said support structure being configured to hold a portion of a rinsing container.

19. The container handling and filling arrangement according to claim 18, wherein a feed line for a rinsing and/or sterilization medium is operatively connected or can be operatively connected with said chamber.

20. The container handling and filling arrangement according to claim 14, wherein:

said piston structure is operatively connected with a lifting roller bearing system and/or its support; or said cylinder structure is operatively connected a said lifting roller bearing system and/or its support.

* * * * *